United States Patent [19]

Hengl

[11] Patent Number: 4,721,100

[45] Date of Patent: Jan. 26, 1988

[54] CANTILEVERED, HORIZONTALLY SLIDABLE MASSAGE BRUSH HAVING AN ADJUSTING COUNTERWEIGHT

[76] Inventor: Gerhard G. Hengl, Jueptnergasse 17/1/14, A-1220 Vienna, Austria

[21] Appl. No.: 860,504

[22] Filed: May 7, 1986

[30] Foreign Application Priority Data

May 8, 1985 [AT] Austria ..... 1381/85

[51] Int. Cl.[4] ..... A61H 15/00; A61H 7/00

[52] U.S. Cl. ..... 128/57; 128/52

[58] Field of Search ..... 128/33, 44–55, 128/57, 58, 60–62 R

[56] References Cited

U.S. PATENT DOCUMENTS

| | | | |
|---|---|---|---|
| 710,689 | 10/1902 | Hickey | 128/33 |
| 2,110,069 | 3/1938 | McGaw | 128/49 |
| 2,360,975 | 10/1944 | Petersen | 128/51 |
| 2,595,812 | 5/1952 | Quillen | 15/92 |
| 3,672,357 | 6/1972 | Ferguson | 128/52 |

FOREIGN PATENT DOCUMENTS

| | | | |
|---|---|---|---|
| 2905383 | 8/1980 | Fed. Rep. of Germany | 128/57 |
| 679994 | 1/1965 | Italy | 128/49 |
| 2166351 | 5/1986 | United Kingdom | 128/57 |

*Primary Examiner*—Edgar S. Burr
*Assistant Examiner*—Tonya Lamb
*Attorney, Agent, or Firm*—Young & Thompson

[57] ABSTRACT

A massaging machine comprises a roller brush having a plurality of radially extending flexible fingers thereon, the brush rotating about a horizontal axis so that the fingers massage a person lying below the brush. The brush is slidable horizontally on a cantilevered frame which is swingable about a horizontal axis and is counterweighted, the position of the counterweight being adjustable so as to adjust the pressure with which the fingers of the roller brush contact the user. The brush is bodily slidable along the horizontal frame, and a counterweight is automatically slidable in the opposite direction as the brush, to maintain constant the pressure of the brush on the user. The fingers of the brush are releasably retained by a horizontal member, immediately before they contact the user, so that the fingers are bent back and then snap against the user.

1 Claim, 4 Drawing Figures

CANTILEVERED, HORIZONTALLY SLIDABLE MASSAGE BRUSH HAVING AN ADJUSTING COUNTERWEIGHT

BACKGROUND OF THE INVENTION

This invention involves a massaging machine, the main massaging component of which consists of a brush-like roller with flexible massaging fingers: the massaging component is a fixed steel framework, inside and perpendicular to which is an adjustable level steel tube frame with a supporting and driving system to provide longitudinal movement along the steel tube framework for the massaging component, with a surface below and parallel to the length of the steel tube framework upon which the person to be massaged lies.

Similar massaging machines of this type are already known, specifically to be compared to the present invention are the characteristics of the system disclosed in DE-OS 29 05 383 (PFANSTIEL). Pfanstiel uses an unspecified finger brush roller as a massaging component, this being set in rotational motion by way of a motor drive, the drive unit providing for movement along the guide rails of the main frame: in the case of this present invention however a roller brush with finger-shaped protrusions is rotated by way of a linear actuator transmission gearing in a direction of motion opposite to that of the massaging movement, and by means of a pretensioning roller. The fingers on the roller brush are provided with a certain degree of tension before contacting the surface to be massaged in order to achieve the finger touch and stroking effect of humam fingers similar to that which occurs in orthodox manual massage. At the same time a motor-driven linear actuator provides for forward and backward movement of the entire massaging roller. In contrast to the Pfanstiel system, with its frame support at one end only and the spring component at the other end of this framework the massaging process is not completely consistent in terms of downward pressure: the present invention however provides this balanced downward pressure by construction of the steel tube framework as a variable ratio counterbalance mechanism.

SUMMARY OF THE INVENTION

The present invention comprises a massaging machine of the type described above providing automatic adaption of the finger shaped roller brush to the contour lines of the human body while rotating opposite to the direction of massage under conditions of constant massage pressure. The person to be massaged can remain in one position or change this position during the massaging process without the massaging machine having to be stopped. Furthermore the natural effect of orthodox finger touch and stroking massage is provided whereby the massaging direction from the feet towards the head regardless which part of the body is being massaged has to be maintained.

The massaging machine described above consists of a steel tube framework constructed of a variable ratio counterbalance protruding beyond the steel tube framework but supported as a rotating component on a shaft in this framework. The steel tube frame is constructed as a double U shape. A fixed and a mobile counterweight with a supporting and driving system are provided below the rotating shaft of the massaging component, with a pretensioning roller which tensions the massaging fingers before these contact the surface to be massaged. The construction provides for rotating movement of the finger roller opposite to the direction of massage in reciprocal horizontal motion while being vertically adjustable for different levels of presettable massage pressure. Furthermore the flexible fingers of the roller brush are provided with pretensioning by way of a resistance, the so-called pretensioning roller before these fingers contact the surface to be massaged and therewith achieve the effect of orthodox finger touch and striking massage.

BRIEF DESCRIPTION OF THE DRAWING

Further objects and advantages of the invention will become apparent from the following description and from the accompanying drawing, wherein.

DETAILED DESCRIPTION OF THE PREFERED EMBODIMENT

Figure 1:
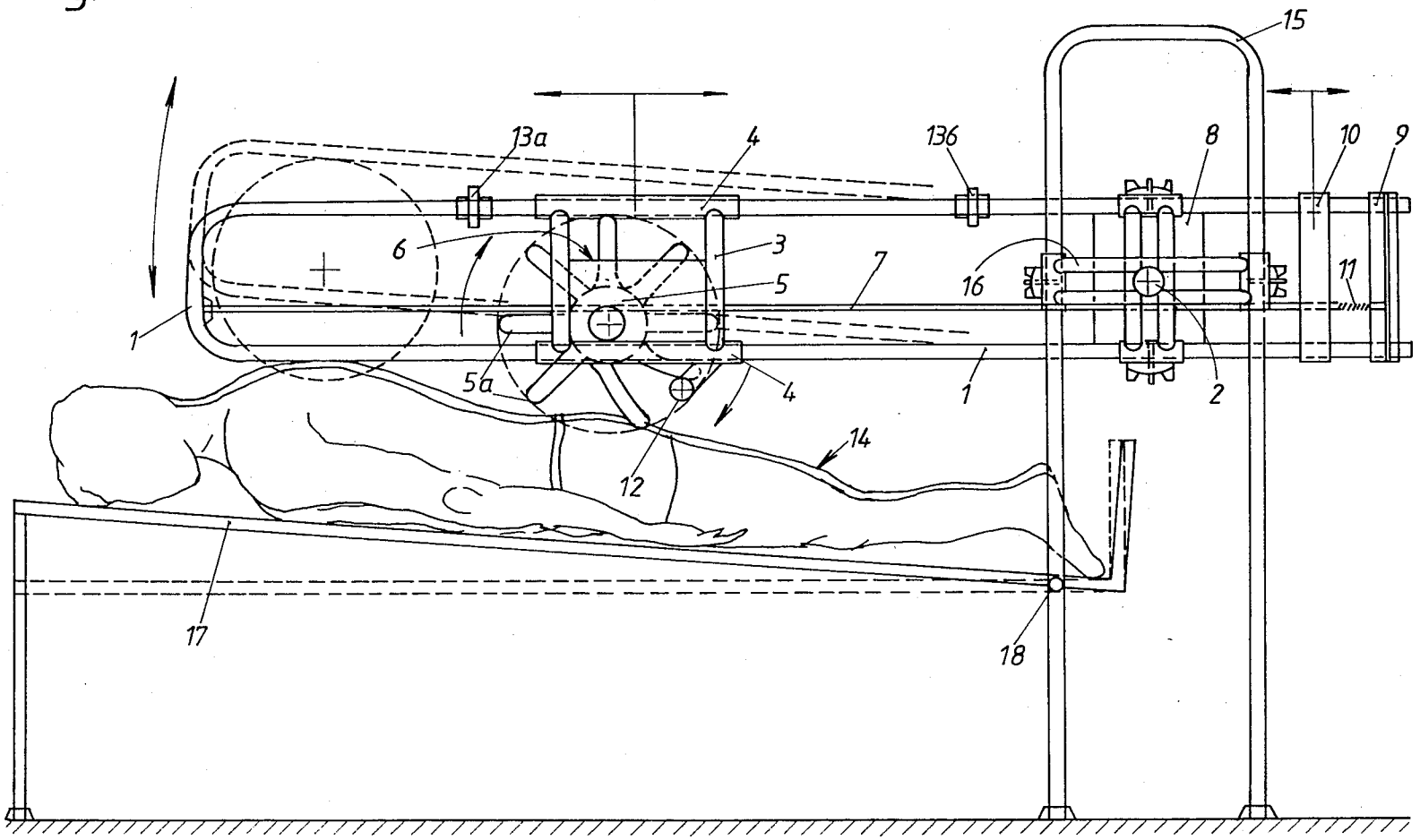
FIG. 1 is a side elevational view of a device embodying my invention.

The massaging system depicted in the drawings consists of a steel tube frame 1 constructed as a double U shaped frame forming a variable ratio counterbalance supported by way of a rotating shaft 2 and divided by this rotating shaft into two sections, the length of massage "a" and the length of counterweight "b." On the steel frame 1 in section "a" is the finger roller brush support 3 moving on sleeve bearings 4. The finger roller brush 5 with its flexible fingers **5*a* is placed in the support 3 and is designed to be removable. The gearing 6 for rotation of the finger roller brush 5 is 6*a* and for the reciprical forward and backward driving of support 3 is 6*b* driven by way of a linear actuator 7*a* and 7*b* and speed controllable electric motors 8**.

The non-moving counterweight 9 depicted in FIG. 1 designed to compensate for the fixed weights in the massaging length "a" is attached to the end of length "b" of the frame 1 in such a way that is provides a firm connection of the two double U shaped frame sections to the frame 1 of the machine. The counterweight 10 driven on frame 1 along the length "b" is attached to the support 3 by way of a linear actuator 11 with the linear actuator **7*b*. These double section linear actuators 11 and 7*b* are arranged so that the counterweight length "b" for 11 has a screw pitch corresponding to X and for the massaging length "a", 7*b*** has a screw pitch determined by the calculation of the unit X times the ratio of length "a" to "b", therewith maintaining the desired and settable massage pressure along the entire massaging length "a".

Figure 2:
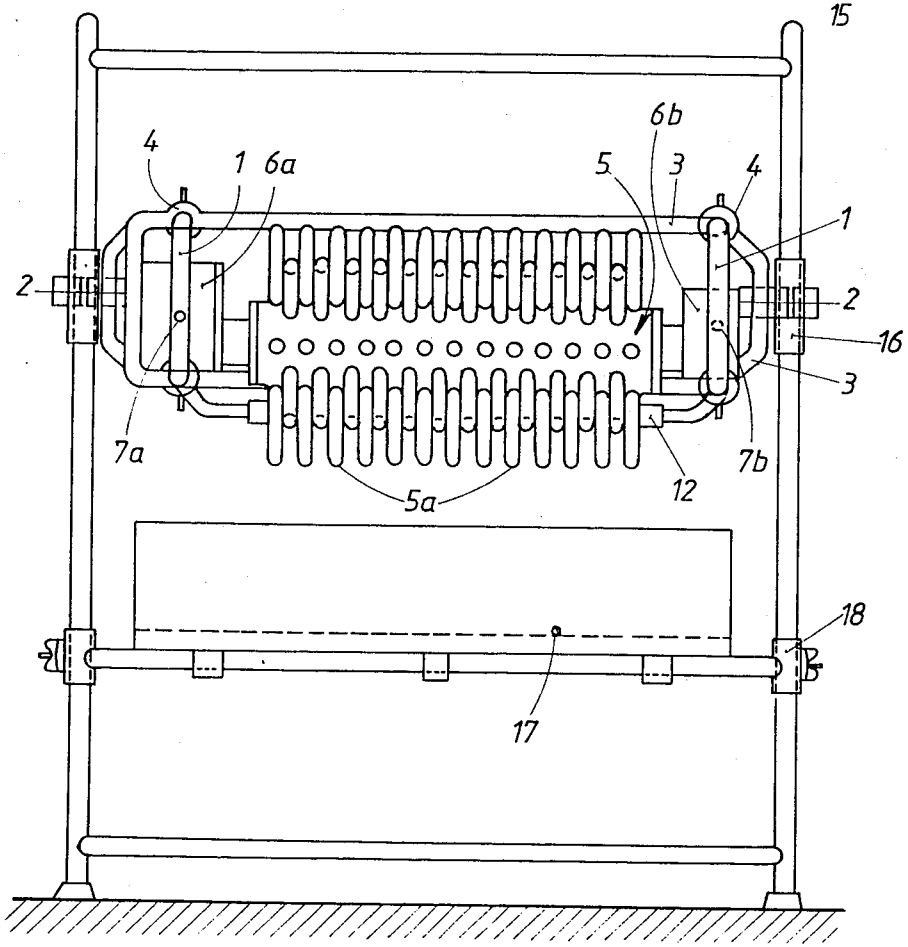
FIG. 2 is a front end view thereof.

The limiters **13*a* and 13*b* depicted in FIG. 1 and FIG. 2 provide for predetermination of the massaging length and at the same time act as limit switches for the motors 8 for forward and backward movement of the finger roller brush support 3 and the counterweight 10 and in one version to raise the steel tube frame 1 in order to prevent contact of the finger roller brush 5 with the surface 14 to be massaged after reaching the limit switch 13*a* farthest from the rotating shaft 2. After the support 3 reaches the limit switch 13*b* closest to the rotating shaft 2 a signal is actuated to lower the steel frame 1 until the preset massage pressure of the finger roller brush 5 has been reached. At the same time another signal is actuated and the support 3** moves forwards in the direction from the feet towards the head.

Figure 3:
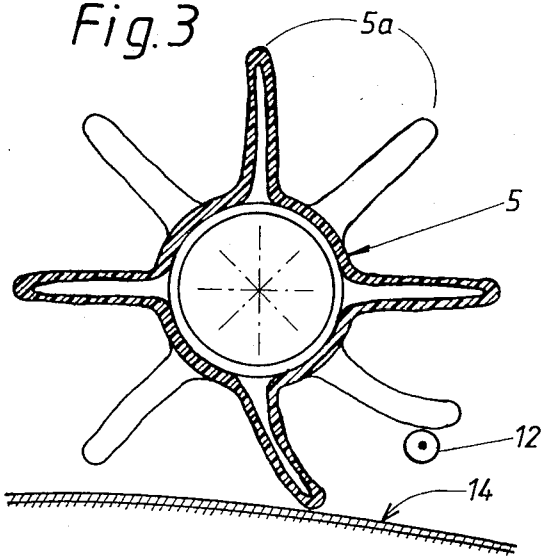
FIG. 3 is a cross section of the finger roller brush.
Figure 4:
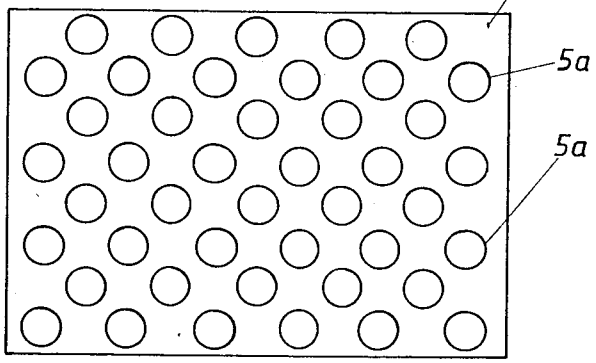
FIG. 4 is a developed view of the finger roller brush.

The finger roller brush 5 depicted in FIG. 1 to FIG. 4 is characterized by being as wide as the average human body and equipped with flexible fingers 5*a* at least five inches long in order to compensate for the irregularities of the surfaces of the human body to be massaged. These fingers 5*a* which are arranged as shown in FIG. 4 in such a way that by rotating the finger roller brush 5 the complete surface in its entire width is massaged are provided with pretension as shown in FIG. 1 to FIG. 3 by the way of the pretensioning roller 12 and can therewith achieve the desired effect of orthodox finger touch and stroking massage. The flexibility of the fingers 5*a* is determined by the spring-like return forces of the finger roller 5 with regard to the surface 14 to be massaged. An increase of massage pressure can be achieved by manual movement of the counterweight 10 using a releasable two part screw nut (not shown): by movement towards the rotating shaft 2 an increase is achieved by reducing the distance from that shaft.

The invention provides for construction of the entire massage system depicted in FIG. 1 to FIG. 4 reference nos. 1–13 with a steel frame 15 connected to an adjustable-level support mechanism 16 for the rotating shaft 2. This steel frame 15 is connected to an adjustable level surface 17 for the person to be massaged to lie on, two of whose adjusted positions are shown in full and phantom line in FIG. 1. Surface 17, if not required can, in order to save space, swivel up above attachment point 18 in the same way as steel frame 1 with its rotating shaft 2 at the same time adjusting the level of the support section.

What is claimed is:

1. A massaging machine comprising a roller having a plurality of outwardly extending resilient fingers thereon, a vertically swinging horizontally-elongated frame along which the roller is mounted for sliding movement, the frame being mounted intermediate its ends but more closely adjacent one end than adjacent the other end, for vertical swinging movement about a horizontal axis on a fixed support, the frame thus having a relatively long portion on one side of said horizontal axis and a relatively short portion on the other side of said horizontal axis, the roller being mounted for sliding movement along said relatively long portion, a counterweight mounted for sliding movement along said relatively short portion, and means simultaneously moving the roller and the counterweight toward or away from each other with a velocity that varies directly as the distance of the roller and the counterweight from said horizontal axis, thereby to maintain substantially constant the pressure with which the roller bears on a user positioned beneath the roller.

* * * * *